US007172460B2

(12) United States Patent
Zhao et al.

(10) Patent No.: US 7,172,460 B2
(45) Date of Patent: Feb. 6, 2007

(54) UNIVERSAL SERIAL BUS CONNECTOR WITH INTEGRAL SHELL

(75) Inventors: Qi-Jun Zhao, Kunshan (CN); Mao-Lin Lei, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/320,043

(22) Filed: Dec. 28, 2005

(65) Prior Publication Data

US 2006/0166555 A1 Jul. 27, 2006

(30) Foreign Application Priority Data

Dec. 28, 2004 (CN) ..... 2004 2 0054848 U

(51) Int. Cl.
*H01R 13/648* (2006.01)

(52) U.S. Cl. ..... 439/607; 361/737; 361/752; 439/76.1; 439/131

(58) Field of Classification Search ..... 439/607, 439/76.1, 131; 361/752, 737
See application file for complete search history.

(56) References Cited

U.S. PATENT DOCUMENTS

| | | | | |
|---|---|---|---|---|
| 6,456,500 | B1 * | 9/2002 | Chen | 361/752 |
| 6,676,419 | B1 * | 1/2004 | Lin et al. | 439/76.1 |
| 6,743,030 | B2 * | 6/2004 | Lin et al. | 439/131 |
| 6,999,322 | B1 * | 2/2006 | Lin | 361/752 |
| 7,004,780 | B1 * | 2/2006 | Wang | 439/353 |
| 7,035,110 | B1 * | 4/2006 | Wang et al. | 361/737 |
| 2004/0233645 | A1 * | 11/2004 | Chen | 361/737 |
| 2006/0068638 | A1 * | 3/2006 | Lin et al. | 439/607 |

* cited by examiner

*Primary Examiner*—Michael C. Zarroli
(74) *Attorney, Agent, or Firm*—Wei Te Chung

(57) ABSTRACT

A universal serial bus connector (1) includes a metal casing (10), an insulative housing (20) and a mating pedestal (30) received in the metal casing, and a printed circuit board (40) with a front portion (41) received in the mating pedestal and a rear portion (42) received in the metal casing. The metal casing forms a mating port (110) and a receiving port (120). The mating port and the receiving port are integrally formed.

3 Claims, 7 Drawing Sheets

UNIVERSAL SERIAL BUS CONNECTOR WITH INTEGRAL SHELL

BACKGROUND OF THE INVENTION

1. Field of the Invention

The present invention relates to a portable memory device, and more particularly to a universal serial bus connector.

2. Description of the Prior Art

The existent portable memory device of an electric appliances is used to process or store data. Such portable memory device is required to have small volume and be easily usable and portable. For example, the currently widely used universal serial bus which has small volume and can be easily carried.

U.S. Pat. No. 6,456,500 B1 issued to Speed Tech on Sep. 24, 2002 discloses a universal serial bus (USB) connector. The conventional USB connector is composed of a bottom cover 1, an upper cover 2, a circuit board 3 and a lateral decorative strip 4. An adapter 31 for engaging with a complementary connector is disposed at a front portion of the circuit board 3. The bottom cover 1 and the upper cover 2 latch with each to form a receiving space for receiving the circuit board 3 and the adapter 3. However, when the conventional USB drops off accidentally, the bottom cover 1 and the upper cover 2 easily disengage or depart.

Accordingly, there is a need for providing a universal serial bus connector with a firm and compact structure.

BRIEF SUMMARY OF THE INVENTION

It is an object of the present invention to provide a universal serial bus connector with a firm and compact structure.

In order to attain the objective above, a universal serial bus connector includes a metal casing, an insulative housing and a mating pedestal received in the metal casing, and a printed circuit board with a front portion received in the mating pedestal and a rear portion received in the metal casing. The metal casing integrally forms a mating port and a receiving port. The receiving port defines an opening. The insulative housing includes a planar body and a rear portion. A retaining portion laterally extends from the rear portion and forms a bump for engaging with the opening of the metal casing at a front portion thereof. Since the mating port and the receiving port are integrally formed, the structure of the universal serial bus connector is compact and firm.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
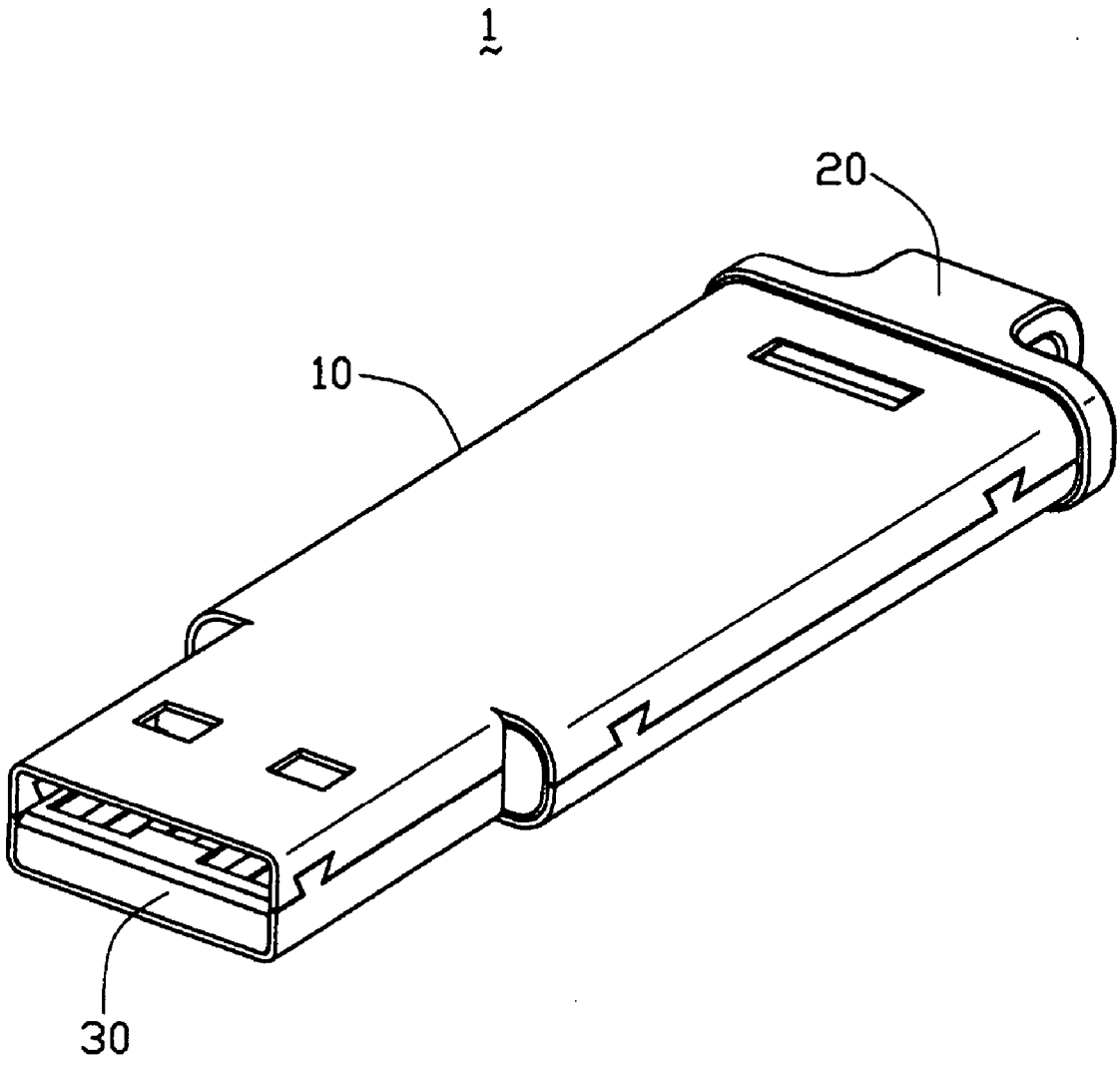
FIG. 1 is a perspective view of a universal serial bus connector according to the first embodiment of the present invention.
Figure 2:
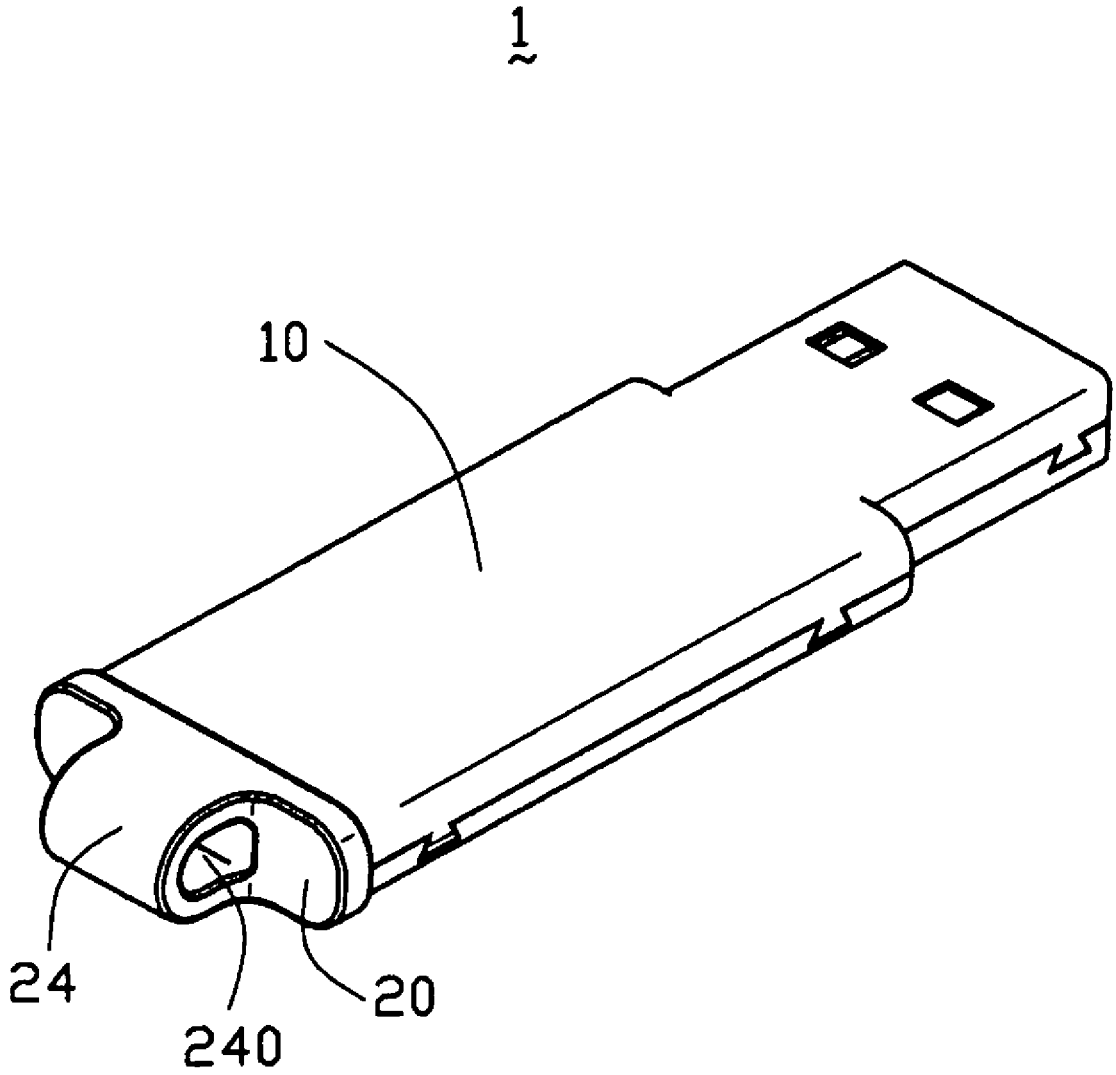
FIG. 2 is another perspective view of the universal serial bus connector.
Figure 3:
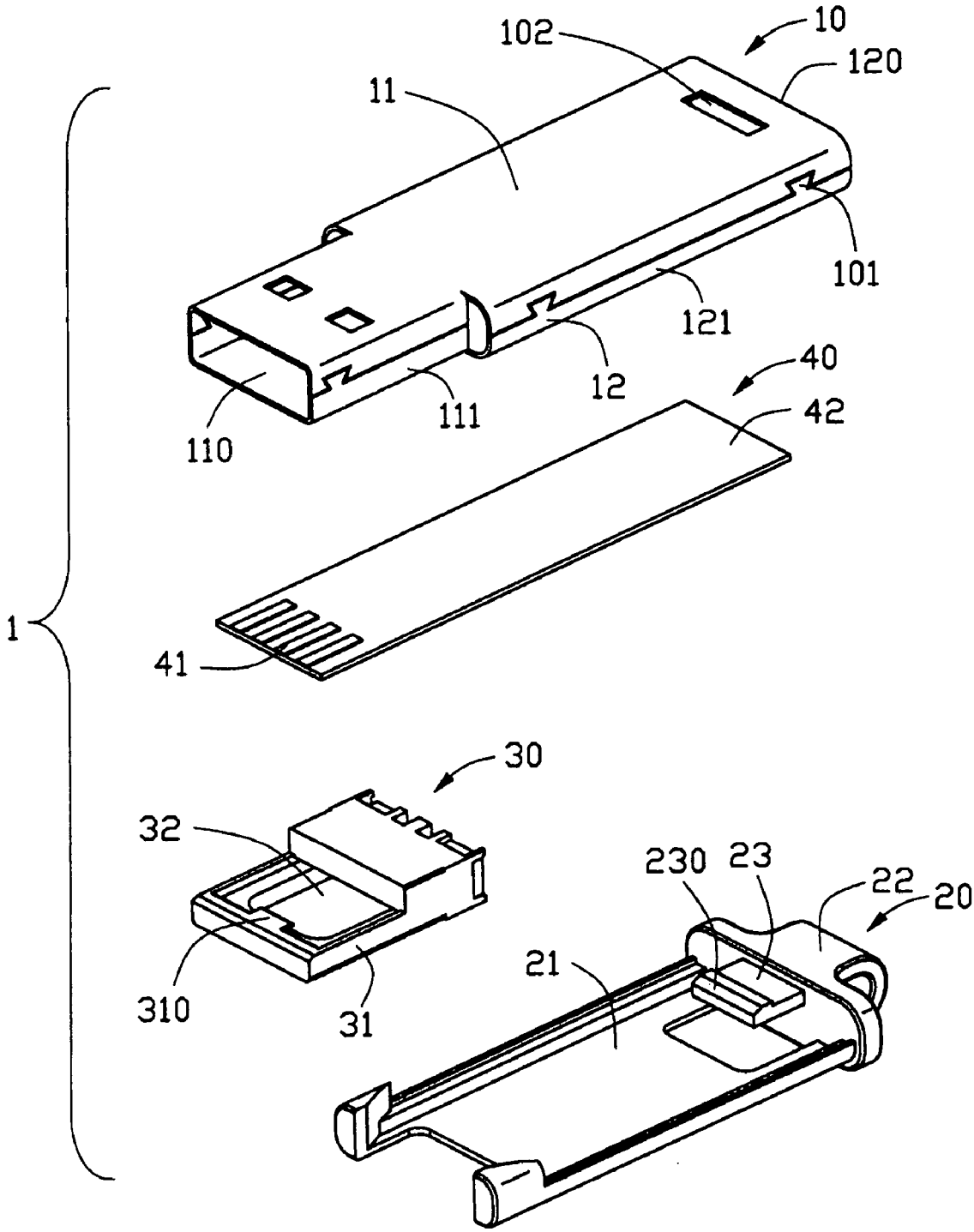
FIG. 3 is an exploded view of the universal serial bus connector.

Refer to FIGS. 1–3, a universal serial bus connector 1 according to the first embodiment of the present invention includes a metal casing 10, an insulative housing 20 received in the metal casing 10, a mating pedestal 30 and a printed circuit board 40.

The metal casing 10 is formed by a top and a bottom metal sheet 11, 12 latched with each other via a plurality of latches 101. The metal casing 10 includes a front mating port 110 for mating with a complementary connector (not shown) and a rear receiving port 120 for receiving the printed circuit board 40 and the insulative housing 20. The top metal sheet 11 defines a rectangular opening 102. The latches 101 are respectively defined in side walls 111 of the mating port 110 and side walls 121 of the receiving port 120.

the insulative housing 20 is received in the mating port 110 and includes a planar body 21 and a rear portion 22. A retaining portion 23 parallel extends from the rear portion 22 and forms a bump 230 at a front portion thereof. When the insulative housing 20 is inserted into the metal casing 10 from the rear receiving port 120, the bump 230 of the retaining portion 23 latches with the opening 102 of the metal casing 10.

The mating pedestal 30 is disposed on the mating pedestal 30 and is formed of a step-shaped portion. The mating pedestal 30 includes an engaging portion 31 and a recess 32. The engaging portion 31 defines a barb 310 at a front end thereof. The printed circuit board 40 includes a front portion 41 with a plurality of golden fingers (not labeled) and a rear portion 42. The printed circuit board 40 rips through the recess 32 with the barb 310 latching the front portion 41.

In addition, the rear portion 22 of the insulative housing 20 includes a projection 24 defining a through hole 240. In use, a rope laces through the through hole 240 for conveniently take the USB.

Figure 4:
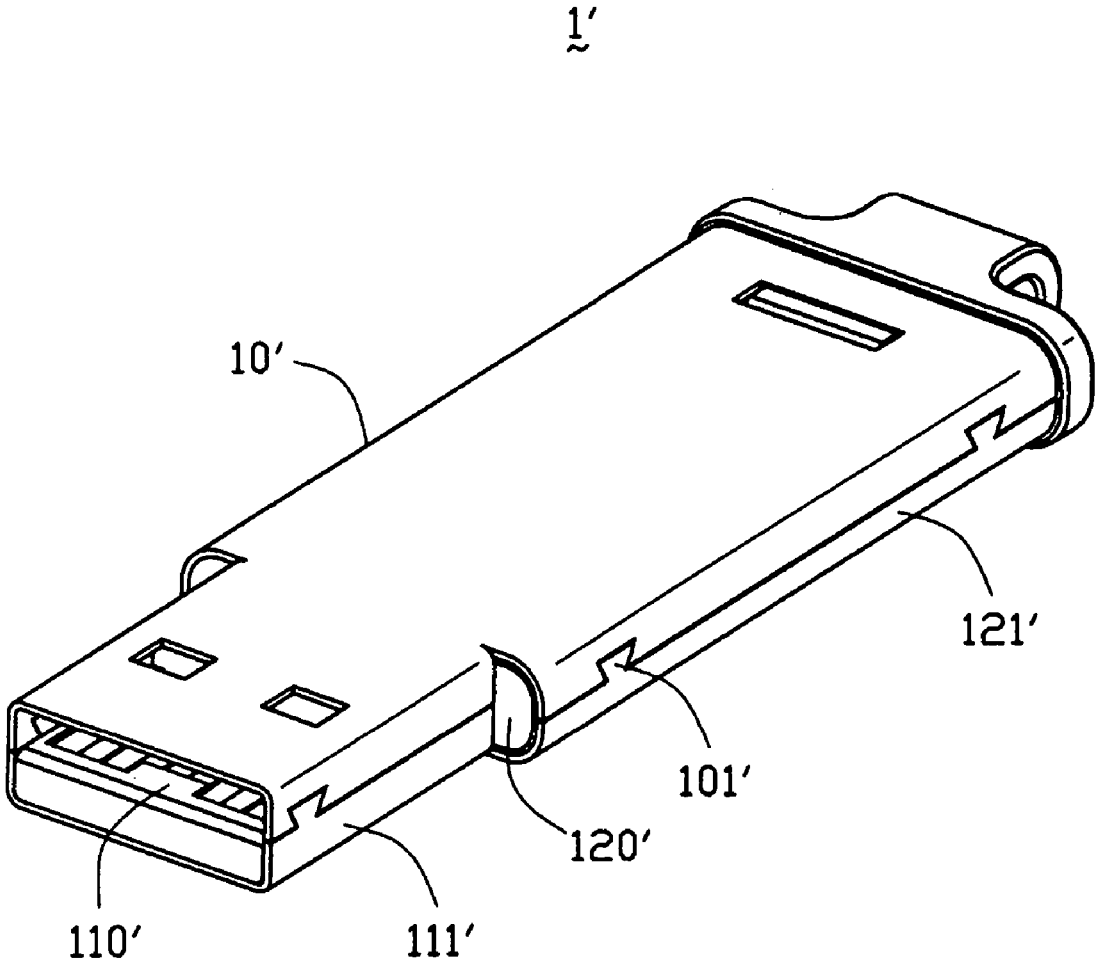
FIG. 4 is a perspective view of the universal serial bus connector according to the second embodiment of the present invention.
Figure 5:
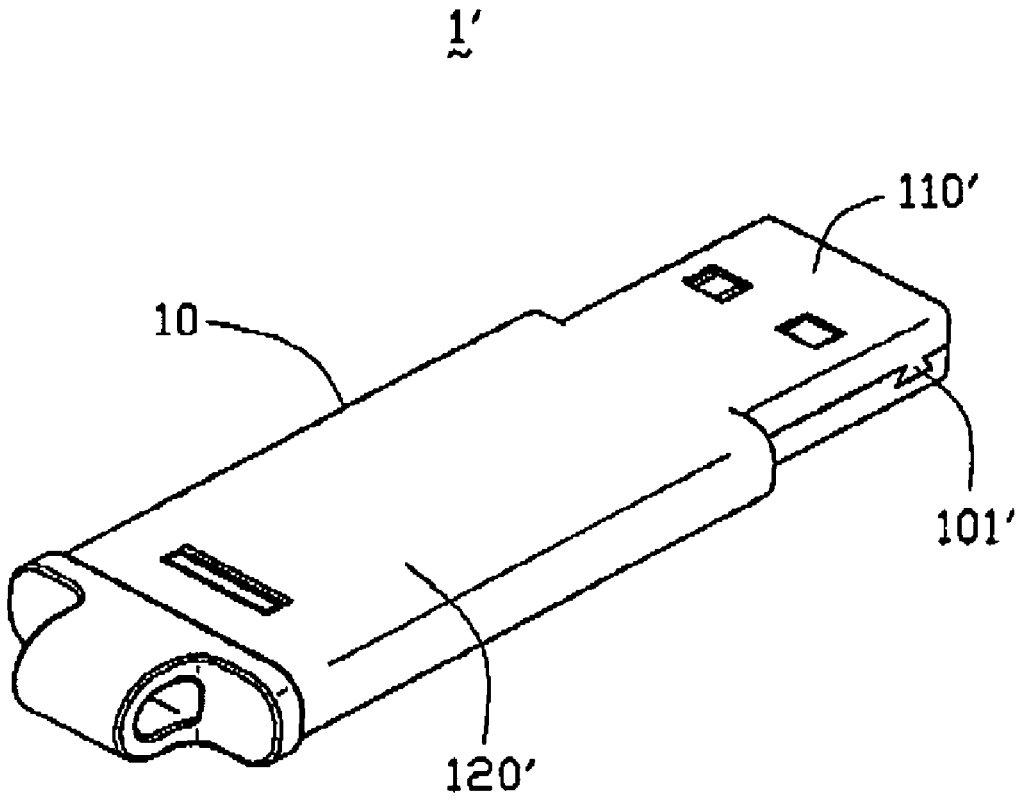
FIG. 5 is another perspective view of the universal serial bus connector according to the second embodiment.
Figure 5A:
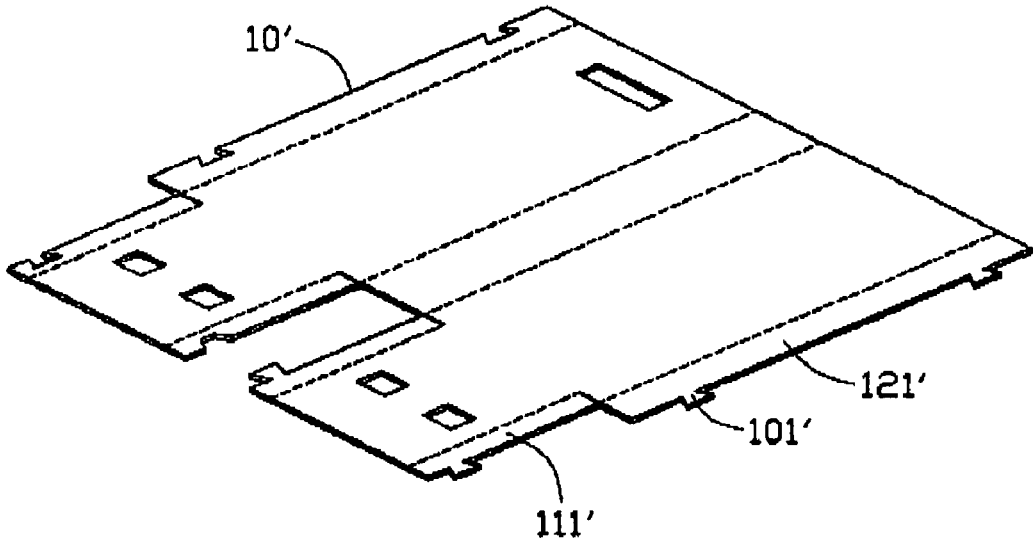
FIG. 5A is a plan view of a metal sheet before being bent to form a metal casing.

Further refer to FIGS. 4–5 and 5A, a second embodiment of the present invention provides a USB 1' having a metal casing 10'. The metal casing 10' is formed by a single metal sheet (shown in FIG. 5A) which is integrally bent into a mating port 110' and a receiving port 120'. The receiving port 120' forms a plurality of latches 101' at side edges thereof. The mating port 110' includes two parts, wherein each part defines a plurality of latches 101' at side edges thereof. Therefore, when the single metal sheet is bent into the metal casing 10', the latches 101' of the receiving port 120' are formed at a side wall 121', and at the same time the latches 101' of the mating port 110' are formed at two side walls 111'.

Figure 6:
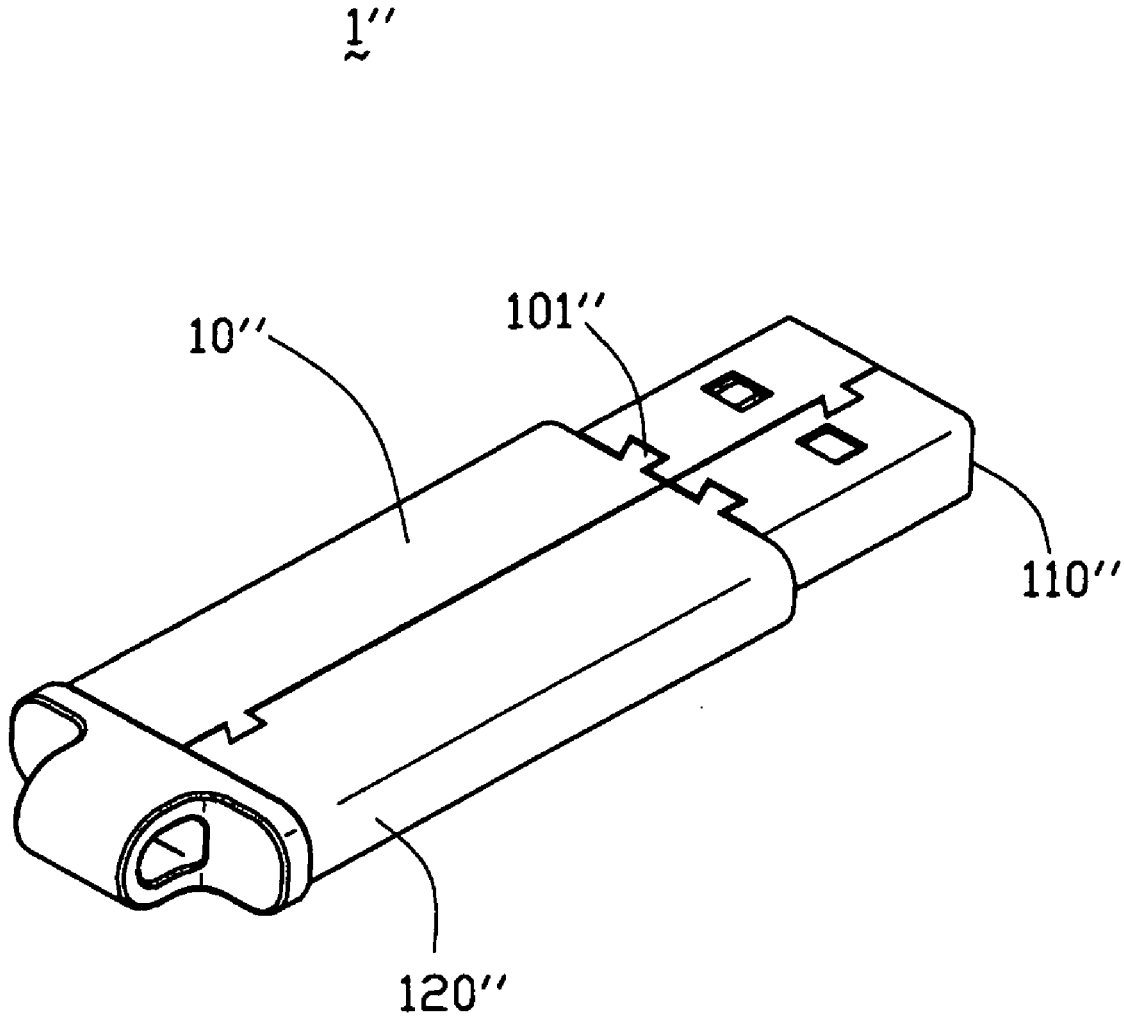
FIG. 6 is a perspective view of the universal serial bus connector according to the third embodiment of the present invention.

Further refer to FIG. 6, a third embodiment of the present invention discloses a USB 1" being formed by a single metal sheet. The single metal sheet is stamped integrally into a mating port 110" and a receiving port 120". The receiving port 120" forms a plurality of latches 101" at side edges and top edges thereof, respectively. The mating port 110" respectively form a plurality of latches 101" at bottom edges and side edges thereof. When the single metal sheet is bent into the metal casing 10", the latches 101" of the top edges of the receiving port 120" and the latches 101" of the bottom edges of the mating port 110" latch with each other.

Comparing with the prior art, the metal sheet integrally forms the mating port and the receiving port to effectively reduce the size of the USB. In addition, the predetermined structure prevents the mating port of the USB from disengaging or departing when the USB drops off accidentally.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A universal serial bus connector, comprising: a metal casing having a mating port and a receiving port; an insulative housing received in the metal casing; a mating pedestal received in the mating port of the metal casing; and a printed circuit board having a front portion and a rear portion, the front portion received in the mating pedestal and the rear portion received in the insulative housing;

the metal casing is formed by a single metal sheet and includes the front mating port and the rear receiving port, the metal sheet defining a plurality of latches at an edge thereof, wherein the mating port and the receiving port of the metal casing are integrally formed; wherein the insulative housing includes a planar body and a rear portion;

wherein a retaining portion extends from the rear portion and defines a bump at a front portion thereof, and wherein the metal sheet defines an opening for engaging with the bump.

2. A universal serial bus connector comprising:

a metal casing defining a mating port at a front end;

an insulative housing received in the metal casing and defining a planar body extending along a longitudinal direction of the metal casing, and a holding section integral with a rear end of the insulative housing and exposed outside of the metal casing;

a printed circuit board supportably disposed on the planar body; and a mating pedestal received in the mating port; wherein the metal casing is assembled onto the housing along a front-to-back direction and stopped by an abutting face of the housing around the holding section under a condition that the housing defines a deflectable latch releasably engageably locked to the metal casing and exposed to an exterior for actuation, the deflectable latch is either at the same level as the metal casing's outside surface or above the metal casing's outside surface.

3. The connector as claimed in claim 2, wherein said printed circuit board defines a front region around the mating pedestal with mating circuit pads thereon.

* * * * *